US011712078B2

(12) United States Patent
Moore

(10) Patent No.: US 11,712,078 B2
(45) Date of Patent: Aug. 1, 2023

(54) WAISTBAND FOR ARTICLE OF APPAREL

(71) Applicant: NIKE, Inc., Beaverton, OR (US)

(72) Inventor: Bruce Y. Moore, Laguna Beach, CA (US)

( * ) Notice: Subject to any disclaimer, the term of this patent is extended or adjusted under 35 U.S.C. 154(b) by 0 days.

(21) Appl. No.: 17/573,885

(22) Filed: Jan. 12, 2022

(65) Prior Publication Data

US 2022/0132961 A1 May 5, 2022

Related U.S. Application Data

(63) Continuation of application No. 16/572,262, filed on Sep. 16, 2019, which is a continuation of application No. 15/454,254, filed on Mar. 9, 2017, now Pat. No. 10,455,877.

(60) Provisional application No. 62/306,963, filed on Mar. 11, 2016.

(51) Int. Cl.
*A41F 9/02* (2006.01)
*A41D 7/00* (2006.01)

(52) U.S. Cl.
CPC ..... *A41F 9/02* (2013.01); *A41D 7/005* (2013.01); *A41F 9/025* (2013.01); *A41D 2300/33* (2013.01)

(58) Field of Classification Search
CPC ..... A41F 9/02; A41F 9/025; A41D 7/005; A41D 2300/33
See application file for complete search history.

(56) References Cited

U.S. PATENT DOCUMENTS

| | | | | |
|---|---|---|---|---|
| 76,871 | A | 4/1868 | Wolfsbruck | |
| 503,520 | A | 8/1893 | Bennett | |
| 898,511 | A | 9/1908 | Schneider | |
| 1,561,712 | A | 11/1925 | Hugo | |
| 1,825,271 | A | 9/1931 | Karberg | |
| 2,349,019 | A * | 5/1944 | Terrell | A41F 9/025 2/221 |
| 5,375,266 | A | 12/1994 | Crisco | |
| 6,286,341 | B2 | 9/2001 | Jackson et al. | |
| 10,455,877 | B2 * | 10/2019 | Moore | A41D 7/005 |
| 11,253,019 | B2 * | 2/2022 | Moore | A41F 9/025 |
| 2002/0099345 | A1 | 7/2002 | Saito et al. | |
| 2012/0036614 | A1 | 2/2012 | Meschter et al. | |
| 2014/0331385 | A1 | 11/2014 | Okies et al. | |
| 2016/0262478 | A1 | 9/2016 | Moore et al. | |
| 2016/0262487 | A1 | 9/2016 | Marechal | |

(Continued)

FOREIGN PATENT DOCUMENTS

EP 1118279 A2 7/2001

OTHER PUBLICATIONS

Intention to Grant received for European Patent Application No. 20181817.6, dated Mar. 18, 2022, 7 pages.

(Continued)

*Primary Examiner* — Gloria M Hale

(74) *Attorney, Agent, or Firm* — Shook, Hardy & Bacon, L.L.P.

(57) ABSTRACT

A waistband for an article of apparel is provided. The waistband may comprise at least one tunnel structure through which one or more cords may extend to allow tensioning of the waistband through pulling of the cord(s), while additionally providing comfort, stretchability, breathability, and adjustability for the wearer through integration of one or more elastic or elastically resilient portions into the waistband.

20 Claims, 7 Drawing Sheets

(56) References Cited

U.S. PATENT DOCUMENTS

| | | | | |
|---|---|---|---|---|
| 2017/0258159 | A1* | 9/2017 | Moore | A41F 9/025 |
| 2017/0325531 | A1 | 11/2017 | Lomax et al. | |
| 2020/0008501 | A1 | 1/2020 | Moore | |

OTHER PUBLICATIONS

Office Action received for Australian Patent Application No. 2021266347, dated Jan. 10, 2023, 4 pages.

* cited by examiner

WAISTBAND FOR ARTICLE OF APPAREL

CROSS-REFERENCE TO RELATED APPLICATIONS

This application is a continuation of U.S. patent application Ser. No. 16/572,262, filed Sep. 16, 2019, and titled "Waistband for Article of Apparel," now issued as U.S. Pat. No. 11,253,019, which is a continuation of U.S. patent application Ser. No. 15/454,254, filed Mar. 9, 2017, and titled "Waistband for Article of Apparel," now issued as U.S. Pat. No. 10,455,877, which claims priority to U.S. Provisional Patent App. No. 62/306,963, filed Mar. 11, 2016, and titled "Waistband for Article of Apparel." The contents of all of the aforementioned applications is incorporated herein by reference in the entirety.

BACKGROUND

Water shorts are commonly worn when engaging in various aquatic activities, such as surfing and recreational swimming. Common styles of water shorts are swim trunks and board shorts. When worn, water shorts cover a pelvic area and upper leg areas of an individual. Problems with typical water shorts include configuring the waistband to ensure that the shorts are relatively tight around the waist so that the shorts remain properly positioned on the individual during the aquatic activities.

BRIEF SUMMARY

This summary is provided to introduce a selection of concepts in a simplified form that are further described below in the detailed description section of this disclosure. This summary is not intended to identify key or essential features of the claimed subject matter, nor is it intended to be used as an aid in determining the scope of the claimed subject matter.

In brief, and at a high level, this disclosure describes, among other things, a waistband for an article of apparel, which may be a pair of water shorts, that includes at least one tunnel structure through which one or more cords may extend to allow tensioning of the waistband through pulling of the cord(s). Additionally, one or more elastically resilient portions may be integrated into the waistband to provide comfort, breathability, stretchability, and adjustability for the wearer.

In one exemplary aspect, an article of apparel is provided. The article comprises a pelvic portion having a waist opening and a pair of leg openings, and a waistband coupled to the pelvic portion at the waist opening. The waistband comprises at least a first waistband portion comprising a first end and a second end, at least a first tunnel structure forming a plurality of parallel courses on the first waistband portion, and at least a first cord extending at least partially through the first tunnel structure. The first tunnel structure slidably couples the first cord to the first waistband portion. The article further comprises at least a first pair of apertures through which a looped portion of the first cord extends from the first tunnel structure.

In another exemplary aspect, a lower body article of apparel is provided. The article comprises a pelvic portion having a waist opening and a pair of leg openings, and a waistband coupled to the pelvic portion at the waist opening. The waistband comprises at least a first waistband portion comprising a first end and a second end, at least a first tunnel structure forming a plurality of parallel courses on the first waistband portion, at least a first cord extending at least partially through the first tunnel structure, the first tunnel structure slidably coupling the first cord to the first waistband portion, at least a first pair of apertures through which a looped portion of the first cord extends from the first tunnel structure, and a joining portion extending between the first end and the second end of the first waistband portion.

In another exemplary aspect, a waistband is provided. The waistband comprises a first waistband portion comprising at least a first end and a second end, at least a first tunnel structure forming a plurality of parallel courses on the first waistband portion, at least a first cord extending at least partially through the first tunnel structure, the first tunnel structure slidably coupling the first cord to the first waistband portion, and at least a first pair of apertures through which a looped portion of the first cord extends from the first tunnel structure.

As used throughout this disclosure, "waistband" may comprise a waistband for an article of apparel, but may also comprise any type of trim piece which can be incorporated into an article of apparel to allow for adjustable tightening. Examples may comprise an underband assembly of a bra, a cuff of a sleeve or pant, a waistband of a jacket or shirt, and the like. Any and all aspects, and any variation thereof, are contemplated as being within the scope herein.

BRIEF DESCRIPTION OF THE DRAWINGS

Illustrative aspects are described in detail herein with reference to the attached drawing figures, which are incorporated by reference and which are intended to be exemplary and non-limiting in nature, wherein.

DETAILED DESCRIPTION

The subject matter of the present disclosure is described with specificity to meet statutory requirements. However, the description is not intended to limit the scope of the technology. Rather, it is contemplated that the claimed subject matter might also be embodied in other ways, to include different features and/or steps, or combinations of features and/or steps, similar to the ones described in this disclosure, and in conjunction with other present or future technologies.

In general, a waistband for an article of apparel, such as board or water shorts, is disclosed below. An exemplary waistband may include at least one cord movably secured to the waistband with a tunnel structure, with at least one looped portion of the cord extending from the tunnel structure so that a lacing cord may be threaded through the looped portion to allow tensioning of the waistband by pulling on the looped portion with the lacing cord. Additional tunnel structures, elastically resilient portions, cords, apertures, and other features that may provide comfort, elasticity, breathability, and improved securement of the waistband against the waist area of the wearer are discussed below with respect to FIGS. 1-8B.

Figure 1:
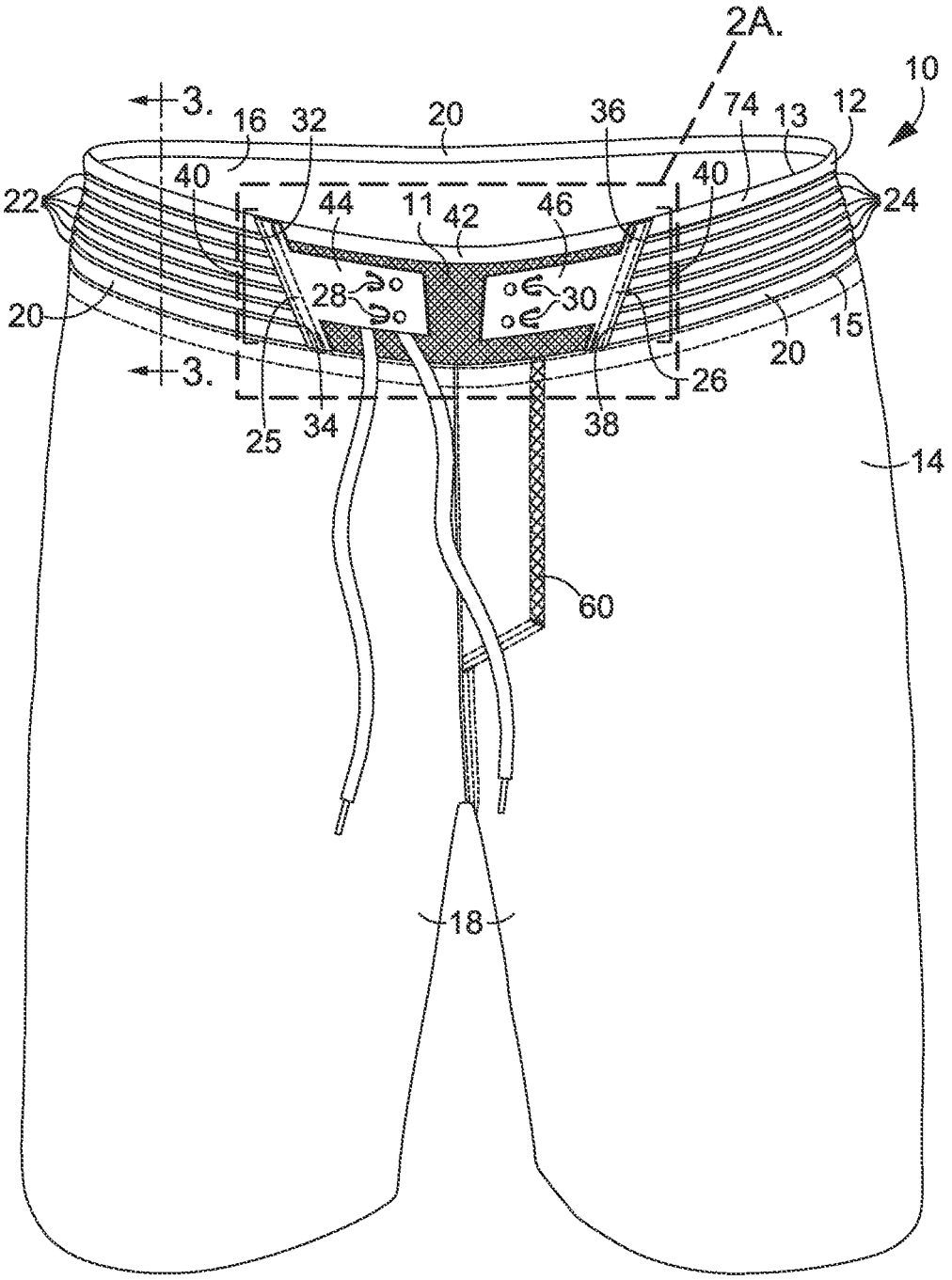
FIG. 1 depicts an article of apparel comprising an exemplary waistband, in accordance with an aspect hereof.

Referring to FIG. 1, a pair of shorts 10 is provided, in accordance with an aspect hereof. The shorts 10 include a pelvic portion 14 having a waist opening 16, a pair of leg portions 18 having openings, and a waistband 12 coupled to the pelvic portion 14 at the waist opening 16. In exemplary aspects, the pelvic portion 14 and the leg portions 18 may be made of a material formed through a weaving or knitting process. Woven materials may provide advantages in terms of durability, abrasion resistance, and the ability to maintain its shape when exposed to water (e.g., low risk of bagging or sagging). Further, the material may be formed to have two-way and/or four-way stretch. In one exemplary aspect, the material used to form the pelvic portion 14 and leg portions 18 may exhibit at least 20% stretch.

In exemplary aspects, the waistband 12 may comprise a separate element that is coupled to the pelvic portion 14 via stitching, adhesives, bonding, welding, and the like. In other exemplary aspects, portions of the waistband 12 may comprise integral extensions of the material used to form the pelvic portion 14 and the leg portions 18. The waistband 12 comprises an upper edge 13 and a lower edge 15, where the lower edge 15 is substantially parallel to the upper edge 13. More specifically, the lower edge 15 of the waistband 12 is coupled to the pelvic portion 14, and the upper edge 13 comprises a free edge of the shorts 10. Although depicted as a pair of shorts 10, it is contemplated herein that the article of apparel may be in the form of a pant, capris, and the like. Any and all aspects, and any variation thereof, are contemplated as being within the scope herein.

The waistband 12 comprises a first waistband portion 20. Any portion of the waistband 12 or first waistband portion 20 may comprise one or more woven, non-woven, stretch-woven, non-stretch woven, and/or knitted materials. For example, the first waistband portion 20 may comprise a woven material having at least 20% stretch to provide elasticity to the waistband 12. The first waistband portion 20 further comprises a first tunnel structure 22 and a second tunnel structure 24 that each form a plurality of separate parallel courses on the first waistband portion 20. To put it another way, each of the courses is substantially parallel to the other courses. In addition, the plurality of separate parallel courses are also substantially parallel to the upper edge 13 and the lower edge 15 of the waistband 12. In additional aspects, courses may be formed on the waistband 12, including on the first waistband portion 20, that are non-parallel, partially parallel, and/or asymmetrical.

In exemplary aspects, the first tunnel structure 22 is positioned on a right side of the waistband 12 when the shorts 10 are in an as-worn configuration, and the second tunnel structure 24 is positioned on a left side of the waistband 12 when the shorts 10 are in an as-worn configuration. The first and second tunnel structures 22, 24 are formed so as to create a space or void between the respective first and second tunnel structures 22, 24 and the underlying first waistband portion 20. The space or void may be sized to receive a cord. In exemplary aspects, each of the first and second tunnel structures 22, 24 may comprise 4 courses, 6 courses, 8 courses, or 10 courses.

The first waistband portion 20 further comprises a first end 25 and a second end 26, generally, as well as a first cord 28 extending at least partially through the first tunnel structure 22, and a second cord 30 extending at least partially through the second tunnel structure 24. Each of the cords 28, 30 follows a continuous serpentine-like course through the respective tunnel structures 22, 24 and associated apertures on the first waistband portion 20. The first tunnel structure 22 slidably or movably couples the first cord 28 to the first waistband portion 20, and the second tunnel structure 24 slidably or movably couples the second cord 30 to the first waistband portion 20. In this respect, the first and second cords 28, 30 may slide through the respective first and second tunnel structures 22, 24 when tensioned (by, for instance, use of a lacing cord) to tighten the waistband 12 circumferentially around a waist area of a wearer of the shorts 10.

The waistband 12 may optionally comprise a textile or polymer element 74 secured to the upper edge 13. For example, the element 74 may be secured to the upper edge 13 such that a portion of the element 74 is secured to an inner-facing surface of the waistband 12, a portion of the element 74 is secured to an outer-facing surface of the waistband 12, and an intervening portion of the element 74 overlays the upper edge 13 of the waistband 12. This may be helpful in minimizing fraying and/or wear and tear on the upper edge 13, and may reduce abrasive contact of the upper edge 13 with a wearer (i.e., the element 74 may have a soft hand to produce a soft feel against the waist of the wearer).

The tunnel structures 22, 24 may comprise a woven material that utilizes the same yarns forming other parts of the waistband 12, such as the first waistband portion 20. Additionally, the tunnel structures 22, 24 may be formed such that they partially or completely obscure the cords 28, 30 positioned therein. Additionally, one continuous cord such as cords 28, 30, or multiple separate cords secured together end to end may be used within the tunnel structures 22, 24. Further, each of the first and second cords 28, 30 may comprise a single cord or may comprise two or more cords that are wound, braided, intermingled, and/or otherwise joined or combined together.

In exemplary aspects, the plurality of parallel courses of the respective first and second tunnel structures 22, 24 may be uniformly spaced and may extend from approximately near the upper edge 13 of the waistband 12 to approximately near the lower edge 15 of the waistband 12. The parallel courses of the tunnel structures 22, 24 may also extend substantially all of the way around the circumference of the waistband 12 or the first waistband portion 20, and/or may wrap around at least a portion of front, side, and rear areas of the waistband 12 or the first waistband portion 20. The configuration and arrangement of the plurality of parallel courses formed by the first and second tunnel structures 22, 24 may allow for evenly distributing the tensioning force generated by use of a lacing cord across the waistband 12 to improve wearer comfort. Moreover, the number of courses associated with each of the first and second tunnel structures 22, 24 may be adjusted to allow for a more diffuse distribution of tensioning forces (i.e., may occur with a greater number of courses) or a more discrete distribution of tensioning forces (i.e., may occur with a fewer number of courses). Any and all aspects, and any variation thereof, are contemplated as being within the scope herein.

Although two cords 28, 30 are shown in two tunnel structures 22, 24 in FIG. 1, in other exemplary aspects, a tunnel structure through which a single cord is extended may be used as well. For instance, a single course of the tunnel structure may extend from the first end 25 to the second end 26 across the midline at the rear area of the waistband 12 before forming a plurality of parallel courses as described above for the tunnel structures 22, 24. In aspects, this configuration may result in an odd number of courses (e.g., 7 courses) for each half of the first waistband portion 20. The first and second ends of the single cord may be anchored at the front of the first waistband portion 20 (e.g., at the first and second ends 25, 26) near either the upper edge 13 or the lower edge 15. Alternatively, the first and second ends of the single cord may be anchored at the rear of the first waistband portion 20 near either the upper edge 13 or the lower edge 15. Any and all aspects, and any variation thereof, are contemplated as being within the scope herein.

In other exemplary aspects, the spacing between the parallel courses of the first and second tunnel structures 22, 24 may be variable. That is, spacing may be closer together along the horizontal midline of the waistband 12 of the first waistband portion 20 and further apart near the upper edge 13 and the lower edge 15. In another example, spacing may be closer together near the upper edge 13 and the lower edge 15 of the waistband 12 or the first waistband portion 20 and further apart near the horizontal midline. Other spacing patterns are contemplated herein. By adjusting the spacing as described, the tensioning force may be distributed in predetermined patterns (e.g., greater at the horizontal midline in the first example above, and greater near the upper and lower edges 13, 15 in the second example above). Any and all aspects, and any variation thereof, are contemplated as being within the scope herein.

The first and second tunnel structures 22, 24 may be integrally formed with the first waistband portion 20. For instance, the first and second tunnel structures 22, 24 may be formed through a knitting or weaving process. As an example, the first waistband portion 20 may be constructed through a weaving process, and this same weaving process may be used to form the first and second tunnel structures 22, 24 integrally with the first waistband portion 20. Similarly, the first waistband portion 20 may be constructed through a knitting process and this same knitting process may be used to form the first and second tunnel structures 22, 24 integrally with the first waistband portion 20. In another example, the first and second tunnel structures 22, 24 may be at least partially formed from separate components that are attached to the waistband 12 via, for example, stitching, bonding, ultrasonic welding, adhesives, and the like. In yet another example, the first and second tunnel structures 22, 24 may be formed by applying, for example, an embroidery pattern to the first waistband portion 20. Any and all examples, and any variation thereof, are contemplated as being within the scope herein.

In further exemplary aspects, the first and second tunnel structures 22, 24 may be formed using a dual-loom technology to weave filaments of a yarn to form a multilayer fabric that includes integrated woven tunnels and/or openings for receiving a cord. For example, the filaments may be woven in such a way as to create a first set of discrete layers of the fabric in some regions of a textile, and a second set of discrete layers of the fabric in other regions of the textile. As the layers that form the textile are continuously woven from the same filaments, there may be little need to sew or attach different pieces of material together to create a desired structure (e.g., the first and second tunnel structures 22, 24). As a result, a durable woven textile structure may be formed that resists heavy, repetitive use (e.g., friction from the cords 28, 30) better than standard stitched or composite structures. The yarns may be woven in an interlocking pattern that may provide greater stability to the textile. This method may also reduce manufacturing costs, as it is less labor-intensive than traditional methods of combining materials in textile structures. The woven structure may be formed using Jacquard machines or Dobby looms, and may be formed from nylon, polyester, cotton, spandex, and/or other natural or synthetic fibers. Different colored filaments may be used as well, to provide a varied visual aesthetic.

The first and second cords 28, 30 may be slidably and/or movably coupled to the first waistband portion 20 with varying degrees of restriction. For example, the first and second tunnel structures 22, 24 may be formed such that the space or void formed between the tunnel structures 22, 24 and the first waistband portion 20 is sized to be smaller than the diameter of the first and second cords 28, 30. In this instance, the tunnel structures 22, 24 would exert a greater degree of friction on the first and second cords 28, 30 when a tensioning force is applied to the cords 28, 30. This may be useful in helping to maintain the first and second cords 28, 30 in a relatively fixed position after the tensioning force is removed or before it is applied. In another example, the first and second tunnel structures 22, 24 may be formed such that the space or void formed between the tunnel structures 22, 24 and the first waistband portion 20 is sized to be larger than the diameter of the first and second cords 28, 30. In this example, the tunnel structures 22, 24 would exert a lesser degree of friction on the first and second cords 28, 30 when a tensioning force is applied to the cords 28, 30. This may be useful when a lower amount of tensioning force needed to tighten the first waistband portion 20 is desired. As well, the first and second tunnel structures 22, 24 may be formed such that the space or void is sized to be approximately the same as the diameter of the first and second cords 28, 30. This may be useful when trying to achieve a balance between the amount of tensioning force needed to tighten the first waistband portion 20 and the degree of friction needed to maintain the cords 28, 30 in a relatively fixed position when the tensioning force is not being applied. Any and all aspects, and any variation thereof, are contemplated as being within the scope herein.

Figure 2A:
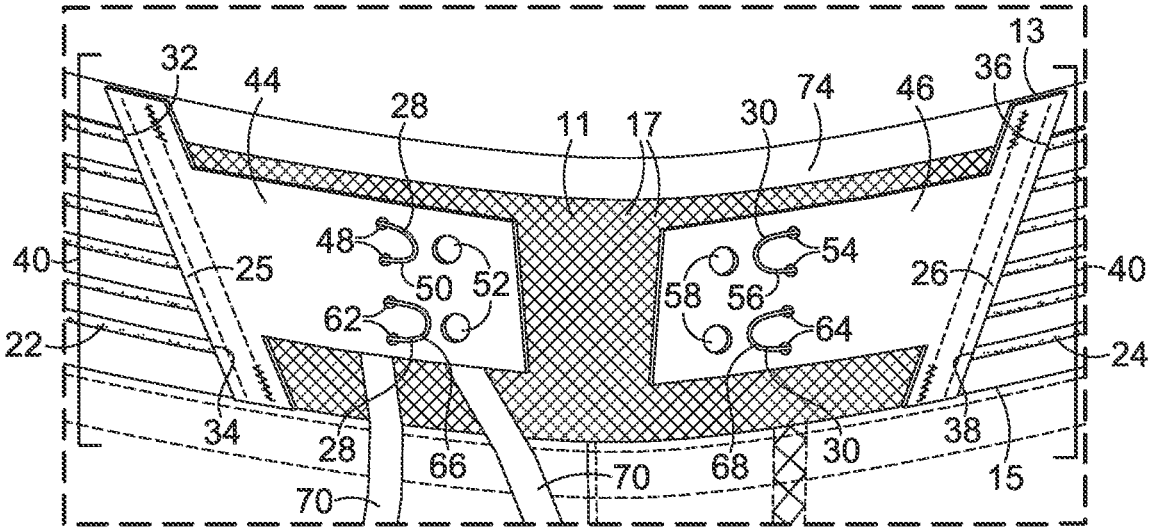
FIG. 2A depicts an enlarged view of the exemplary waistband shown in FIG. 1, in accordance with an aspect hereof.

In exemplary aspects, the first cord 28 may be secured to the first waistband portion 20 at a first end 32 of the first cord 28 and a second end 34 of the first cord 28 at the first end 25 of the first waistband portion 20, and the second cord 30 may be fixed at a first end 36 of the second cord 30 and a second end 38 of the second cord 30 at the second end 26 of the first waistband portion 20 (see FIG. 2A). This may be accomplished, for instance, by using tack-down stitching, bonding, adhesives, and the like. By securing the ends as described, the cords 28, 30 can be tensioned repeatedly with reduced incidence of the cords 28, 30 being pulled out of the first and second tunnel structures 22, 24. The intervening portions of each of the first and second cords 28, 30 remain unaffixed to the first waistband portion 20 such that the intervening portions can slide through the first and second tunnel structures 22, 24. In alternative aspects, the first and second ends 32, 34 of the first cord 28 and the first and second ends 36, 38 of the second cord 30 may be affixed to the first waistband portion 20 in a similar fashion at a rear area of the waistband 12, rather than the front area 42. For instance, with reference to FIG. 5, the first and second ends 32, 34 of the first cord 28 and the first and second ends 36, 38 of the second cord 30 could be secured at a seam line 90 that joins two halves (e.g., a right side and a left side) of the first waistband portion 20 together, in addition to being unsecured, exposed, and/or free floating at this area.

The first waistband portion 20, including the first and second tunnel structures 22, 24, may by more pliable or flexible than the first and second cords 28, 30. To put it another way, the first and second cords 28, 30 may be stiffer than the first waistband portion 20. Thus, by configuring the first and second tunnel structures 22, 24 as described (e.g., by distributing the parallel courses such that they cover the majority of the first waistband portion 20) and by positioning the relatively stiffer first and second cords 28, 30 within the tunnel structures 22, 24, a degree of stiffness may be imparted to the first waistband portion 20 thereby helping to prevent the first waistband portion 20 from folding over onto itself or collapsing during wear. Moreover, the first waistband portion 20 may comprise a higher degree of elasticity than the respective first and second cords 28, 30. As a result of being pliable and elastic, the first waistband portion 20 may provide a softer, more elastic, and more comfortable area for distributing tensioning forces from the first and second cords 28, 30 to the waist of the wearer.

The waistband 12 further comprises a securing region 40 at an anterior or front area 42 of the waistband 12. The securing region 40 may generally include the first and second ends 25, 26 of the first waistband portion 20, and a joining portion 11 that is coupled to and interposed between the first end 25 and the second end 26 of the first waistband portion 20. The securing region 40 further comprises a first tab portion 44 coupled to the first end 25 through which the first tunnel structure 22 with its respective first cord 28 extends (depicted more clearly in FIG. 2A), and a second tab portion 46 coupled to the second end 26 through which the second tunnel structure 24 with its respective second cord 30 extends (depicted more clearly in FIG. 2B). The exemplary securing region 40 is shown in greater detail in FIGS. 2A-2B and FIG. 3, and is not limited to the components referenced, which are merely exemplary. In exemplary aspects, the shorts 10 may also comprise a foldless fly 60 (i.e., a mock fly), which provides an appearance of an adjustable closure at the front area 42 of the shorts 10, but lacks an access opening.

Referring now to FIG. 2A, the securing region 40 depicted in FIG. 1 is provided in greater detail, in accordance with an aspect hereof. In FIG. 2A, the first end 25, and more specifically, the first tab portion 44, comprises at least a first pair of apertures 48. The first pair of apertures 48 extend at least partially through the thickness of the first tab portion 44 to provide access to the first tunnel structure 22 and the first cord 28 contained therein. A looped portion 50 of the first cord 28 extends from the first pair of apertures 48 (i.e., is exposed outside of the first tunnel structure 22). Adjacent to the first pair of apertures 48 is a third pair of apertures 52 extending through the first tab portion 44. In other words, the third pair of apertures 52 extend from an outer-facing surface of the first tab portion 44 through to an inner-facing surface of the first tab portion 44. In exemplary aspects, the third pair of apertures 52 may comprise holes for threading a lacing cord 70.

The second end 26, and more specifically, the second tab portion 46, comprises a second pair of apertures 54. The second pair of apertures 54 extend at least partially through the thickness of the second tab portion 46 to provide access to the second tunnel structure 24 and the second cord 30 contained therein. A looped portion 56 of the second cord 30 extends from the second pair of apertures 54 (i.e., is exposed outside of the second tunnel structure 24). Adjacent to the second pair of apertures 54 is a fourth pair of apertures 58 extending through the second tab portion 46. In other words, the fourth pair of apertures 58 extend from an outer-facing surface of the second tab portion 46 through to an inner-facing surface of the second tab portion 46. In exemplary aspects, the fourth pair of apertures 58 may comprise holes for threading the lacing cord 70.

Additionally provided in FIG. 2A are optional fifth and sixth pairs of apertures 62, 64 through which additional looped portions 66, 68 of the respective first and second cords 28, 30 extend out of the respective first and second tunnel structures 22, 24. By providing additional pairs of apertures such as the fifth and sixth pair of apertures 62, 64, any tensioning force generated by the lacing cord 70 may be distributed more evenly to the first and second cords 28, 30. It should be noted that any number of apertures and corresponding looped portions may be provided on the respective first and second ends 25, 26 and/or the tab portions 44, 46. Additionally, any number of apertures extending through the first and second tab portions 44, 46 for threading the lacing cord 70 may be provided as well. The combination of elements shown in FIGS. 1 and 2A is merely exemplary, and more or fewer are possible, including in different locations.

The joining portion 11 is coupled to the first end 25 and the second end 26 of the first waistband portion 20 via, for example, bonding, stitching, welding, and the like, and may comprise an elastic or elastically resilient material, such as a stretch-knit or stretch-woven textile, that provides greater circumferential elasticity in the waistband 12 than the first waistband portion 20 by itself, and/or also, than the first and second cords 28, 30. For instance, in exemplary aspects, the joining portion 11 may have a greater degree of elasticity than the first waistband portion 20 (e.g., greater than 25% stretch). In exemplary aspects, the joining portion 11 may include a plurality of perforations, or apertures 17, to provide breathability for increased comfort to the wearer. The plurality of apertures 17 may be engineered through the knitting or weaving process used to form the joining portion 11, or the apertures 17 may be formed by incising or perforating the joining portion 11 in a post-processing step. As shown more clearly in FIG. 6, the joining portion 11 may also comprise the lacing cord 70. In exemplary aspects, the lacing cord 70 may be affixed to the joining portion 11 via stitching, bonding and the like, and is provided for tightening the first waistband portion 20.

The joining portion 11 may allow a more seamless securement of the waistband 12 than traditional waistband constructions where the first and second ends of the waistband are secured using buttons or snaps and a zippered fly. When combined with the foldless fly 60 (i.e., the mock fly), the joining portion 11 also provides for enhanced modesty and allows for easy donning and doffing of the shorts 10 by the wearer.

As shown in FIGS. 1 and 2A, at least one aperture of the third pair of apertures 52 may be aligned circumferentially on the waistband 12 with looped portions 50, 66 of the first cord 28, or with at least one aperture of the first pair of apertures 48 or the fifth pair of apertures 62. To put it another way, at least one aperture of the third pair of apertures 52 may be aligned along substantially the same horizontal plane with looped portions 50, 66 of the first cord 28, or with at least one aperture of the first pair of apertures 48 or the fifth pair of apertures 62. Additionally, at least one aperture of the fourth pair of apertures 58 may be aligned circumferentially along substantially the same horizontal plane with looped portions 56, 68 of the second cord 30, or with at least one aperture of the second pair of apertures 54 or the sixth pair of apertures 64. Alignment of the apertures 52, 58 with looped portions 50, 66 and 56, 68 of the first and second cords 28, 30 may allow more direct tensioning of the first and second cords 28, 30 with the lacing cord 70 when it is threaded.

Figure 2B:
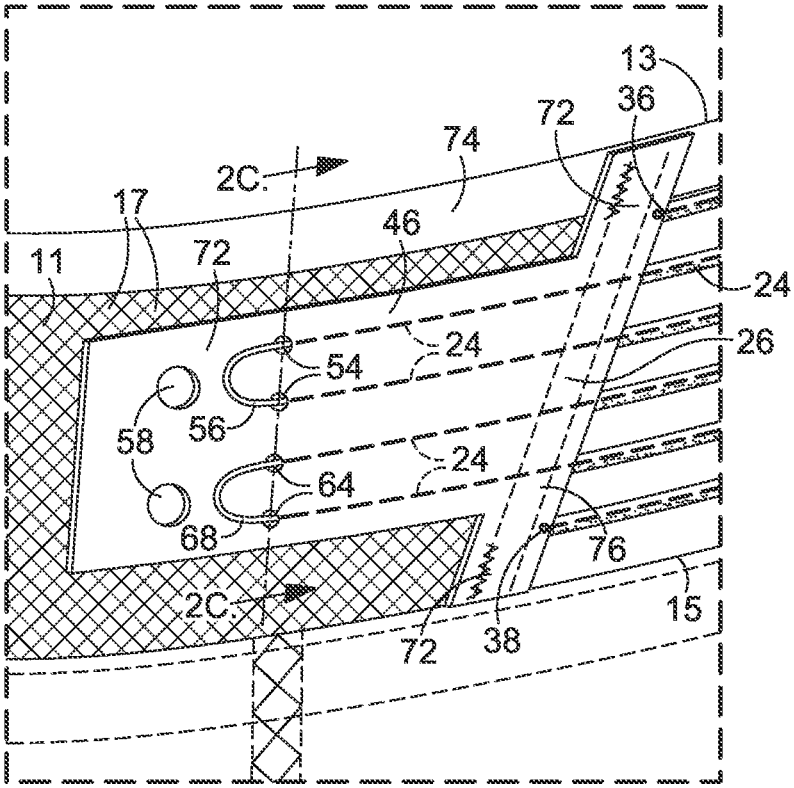
FIG. 2B depicts a further enlarged view of the exemplary waistband shown in FIG. 2A, in accordance with an aspect hereof.

Referring now to FIG. 2B, a further enhanced view of a portion of the securing region 40 shown in FIG. 1 is provided, in accordance with an aspect hereof. In FIG. 2B, the second end 26 of the first waistband portion 20 is shown. The second tunnel structure 24 extends from the first waistband portion 20 into the second tab portion 46. The second tunnel structure 24 within the second tab portion 46 is denoted by dotted lines. The second tunnel structure 24 may be located or extend through an intervening space in the second tab portion 46. In exemplary aspects, the tab portions 44, 46 may be formed from a separate element 72 than the first waistband portion 20, and may include a single, unified construction or a multilayer composite construction. The layered aspect of the second tab portion 46 is shown in more detail in FIG. 2C. In other exemplary aspects, the first and second tab portions 44, 46 may comprise integral extensions of the material used to form the first waistband portion 20. Any and all aspects, and any variation thereof, are contemplated as being within the scope herein.

Figure 2C:
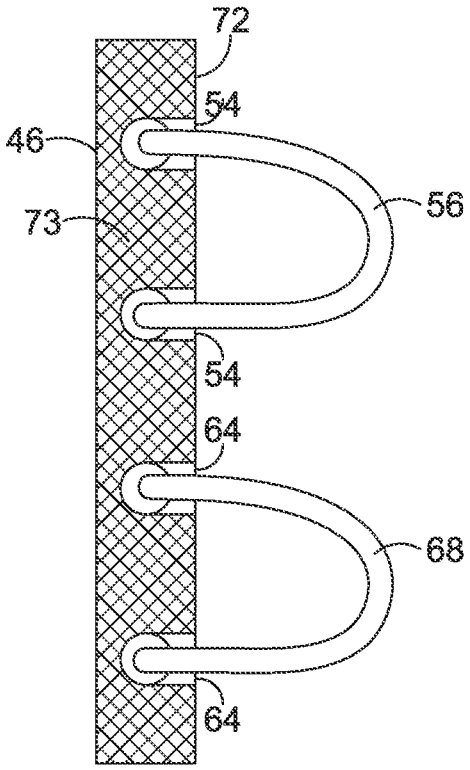
FIG. 2C depicts a cross-section view of a tab portion of the exemplary waistband shown in FIGS. 2A and 2B, in accordance with an aspect hereof.

Referring now to FIG. 2C, a cross-section view taken along cut line 2C-2C of the second tab portion 46 shown in FIGS. 2A-2B is provided, in accordance with an aspect hereof. The second tab portion 46 is shown in detail in FIG. 2C merely for exemplary purposes. In various aspects of the waistband 12, the element 72 forming the second tab portion 46 may be formed from a single layer of material. The element 72 may also be formed by folding the single layer of material onto itself to create a space between the folded-over layers. Additionally, the element 72 may be formed from a composite piece with multiple layers of material joined together at one or more places (e.g., stitched, bonded, adhered, and/or welded, for example). The element 72 may be a textile or polymer element, and may be bonded, adhered, stitched, and/or otherwise joined to the second end 26 of the waistband 12.

As shown in FIG. 2C, the second tab portion 46 includes an intervening portion 73 through which the second tunnel structure 24 extends, or travels therethrough. This may be accomplished, for instance, by forming a tunnel structure in the intervening portion 73 (using a mechanical process, a laser, a water jet, and the like). Alternatively, the second tunnel structure 24 may extend or travel through a space formed when using different layers (or a folded-over layer) to form the second tab portion 46. The looped portions 56, 68 are also shown extending from the intervening portion 73 through the outer-facing surface of the second tab portion 46. The second tab portion 46, like the first tab portion 44, may have a hinge-like portion where it joins the first waistband portion 20 to allow the second tab portion 46 to be folded away from the joining portion 11. A similar construction holds true for the first tab portion 44.

Figure 3:
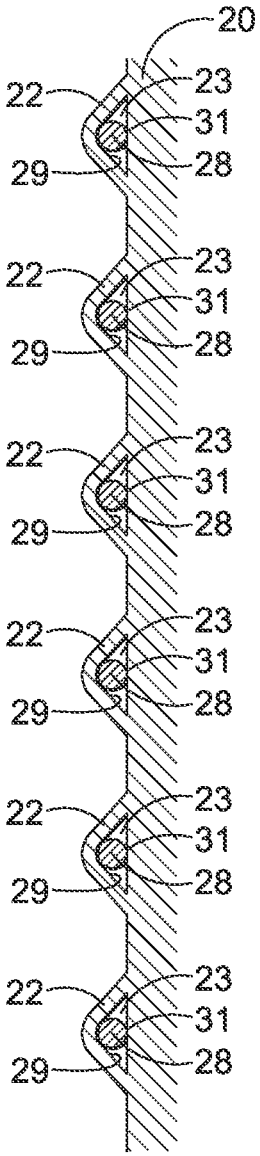
FIG. 3 depicts a cross-section view of the exemplary waistband shown in FIG. 1, in accordance with an aspect hereof.

Referring to FIG. 3, a cross-section view taken along cut line 3-3 of the first waistband portion 20 shown in FIG. 1, with the first cord 28 extending through the tunnel structure 22, is provided, in accordance with an aspect hereof. Additionally, a space 23 formed in the first tunnel structure 22 through which the first cord 28 passes is located between an inner facing surface 29 of the tunnel structure 22 and an outer-facing surface 31 of the first waistband portion 20. This space 23 may be sized to encase the first cord 28 with various degrees of restriction, as discussed in the earlier sections. As shown in FIG. 3, the first cord 28 follows a plurality of parallel courses formed by the first tunnel structure 22 on the first waistband portion 20. The first cord 28 is slidably coupled to the first waistband portion 20 by the first tunnel structure 22, allowing the first cord 28 to slide through the first tunnel structure 22 when tensioned at the exposed looped portions 50, 66 at the first end 25, as shown in FIG. 2A. The tunnel structure 22 may be integrally formed from the material(s) forming the first waistband portion 20, as shown in FIG. 3.

Figure 4:
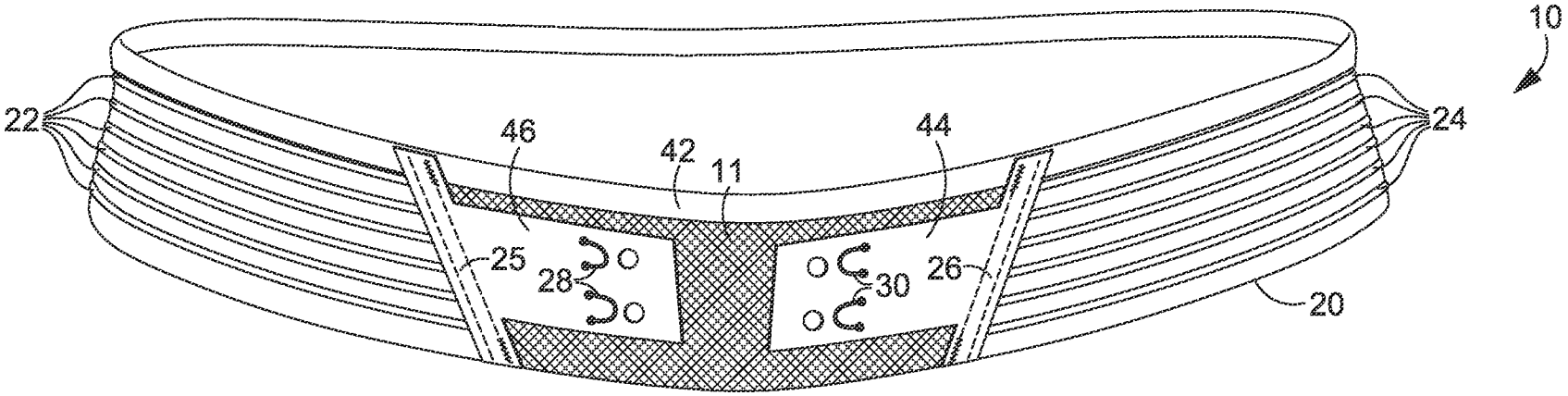
FIG. 4 depicts a front area of the exemplary waistband shown in FIG. 1 separate from the article, in accordance with an aspect hereof.
Figure 5:
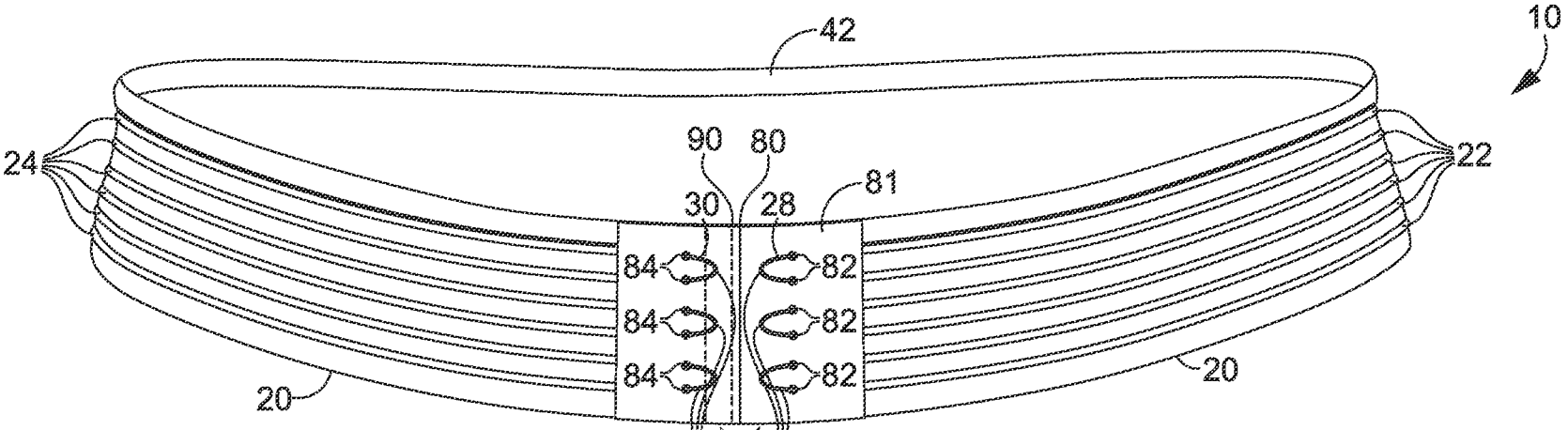
FIG. 5 depicts a rear area of the exemplary waistband shown in FIG. 1 separate from the article, in accordance with an aspect hereof.

Referring to FIGS. 4 and 5, the waistband 12 is shown in isolation to further illustrate aspects herein. For example, FIG. 4 depicts the front area 42 of the waistband 12 as previously discussed. Referring to FIG. 5, a posterior or rear area 80 of the waistband 12 shown in FIG. 1 is depicted, in accordance with an aspect hereof. As seen in FIG. 5, the first and second tunnel structures 22, 24 extend around the sides of the waistband 12 to the rear area 80, such that the first and second tunnel structures 22, 24 encircle at least a portion of the waistband 12 (e.g., the first and second tunnel structures 22, 24 may encircle at least 40%, at least 50%, at least 60%, at least 75%, at least 80%, at least 85%, or up to at least 90% of the waistband 12 or the first waistband portion 20).

The rear area 80 of the waistband 12 comprises a first plurality of rear apertures 82 and a second plurality of rear apertures 84 that may extend through a thickness of an optional overlay element 81 to provide access to the first and second tunnel structures 22, 24 and the first and second cords 28, 30 contained therein. The overlay element 81 may be joined to an outer-facing surface of the first waistband portion 20 at the rear area 80 (e.g., through stitching, adhering, bonding, welding, etc.). The overlay element 81 may comprise a similar material as the element 72 used to form the first and second tab portions 44, 46, and may provide reinforcement at the rear area 80 to reduce wear and tear around the first and second plurality of rear apertures 82, 84. A first plurality of looped portions 86 of the first cord 28 extend out of the first plurality of rear apertures 82 to expose the first cord 28 at the rear area 80, and a second plurality of looped portions 88 of the second cord 30 extend out of the second plurality of rear apertures 84 to expose the second cord 30 at the rear area 80.

Exposing or extending the cords 28, 30 from the first and second tunnel structures 22, 24 at the rear area 80 of the waistband 12 may allow for a greater length of the cords 28, 30 to be used in the tunnel structures 22, 24. This, in turn, may provide greater flexibility in the waistband 12. Further, by increasing the amount or length of the cords 28, 30 that can be extended from various apertures formed in the waistband 12, a greater degree of circumferential tensioning may be achieved.

Furthermore, with respect to FIG. 5, in exemplary aspects, the rear area 80 of the waistband 12 may comprise a gap portion 89 at which the first and second cords 28, 30 and the tunnel structures 22, 24 may be absent. In one exemplary aspect, the gap portion 89 may include a seam line 90 that joins two halves (e.g., a right side and a left side) of the first waistband portion 20 together. The gap portion 89 may provide a level of separation between the tunnel structures 22, 24 and their respective cords 28, 30, and by doing this, the gap portion 89 may provide enhanced flexibility at the rear area 80 of the waistband 12. This may be useful, for example, when a wearer is leaning forward or reaching during activities, such as surfing. As a result, the shorts 10 may be more flexible and less restrictive to the wearer.

The rear area 80, and more specifically the gap portion 89, may provide enhanced flexibility in the waistband 12 when tensioned, as well. As an example, when tension is applied to the first and second cords 28, 30 by the lacing cord 70, the first and second plurality of rear apertures 82, 84 may help to anchor the cords 28, 30 to the rear area 80 of the waistband 12. As a result, the gap portion 89 may stretch, enhancing flexibility in the waistband 12.

As explained above, in an alternative aspect, the first and second ends 32, 34 of the first cord 28 and the first and second ends 36, 38 of the second cord 30 may also be secured to the first waistband portion 20 at the rear area 80 (e.g., near the gap portion 89) shown in FIG. 5, instead of at the front area 42 as shown in FIG. 2A. In this respect, a portion of the first tunnel structure 22 and the second tunnel structure 24 may extend to, for instance, the seam line 90, and the respective cords 28, 30 may be secured to the first waistband portion 20 at or near the seam line 90. In alternative aspects, there may not be the separate first and second tunnel structures 22, 24 on the waistband 12, and instead, there may be a single tunnel structure that extends continuously around the waistband 12, including across and/or around the rear area 80. In such an aspect, the rear area 80 may not include the seam line 90 (e.g., the waistband 12 may be formed from one portion of material instead of from multiple pieces or sections that are joined together). A single tunnel structure configuration may still include exposed portions of cord(s) at the rear area 80 or at other locations.

Figure 6:
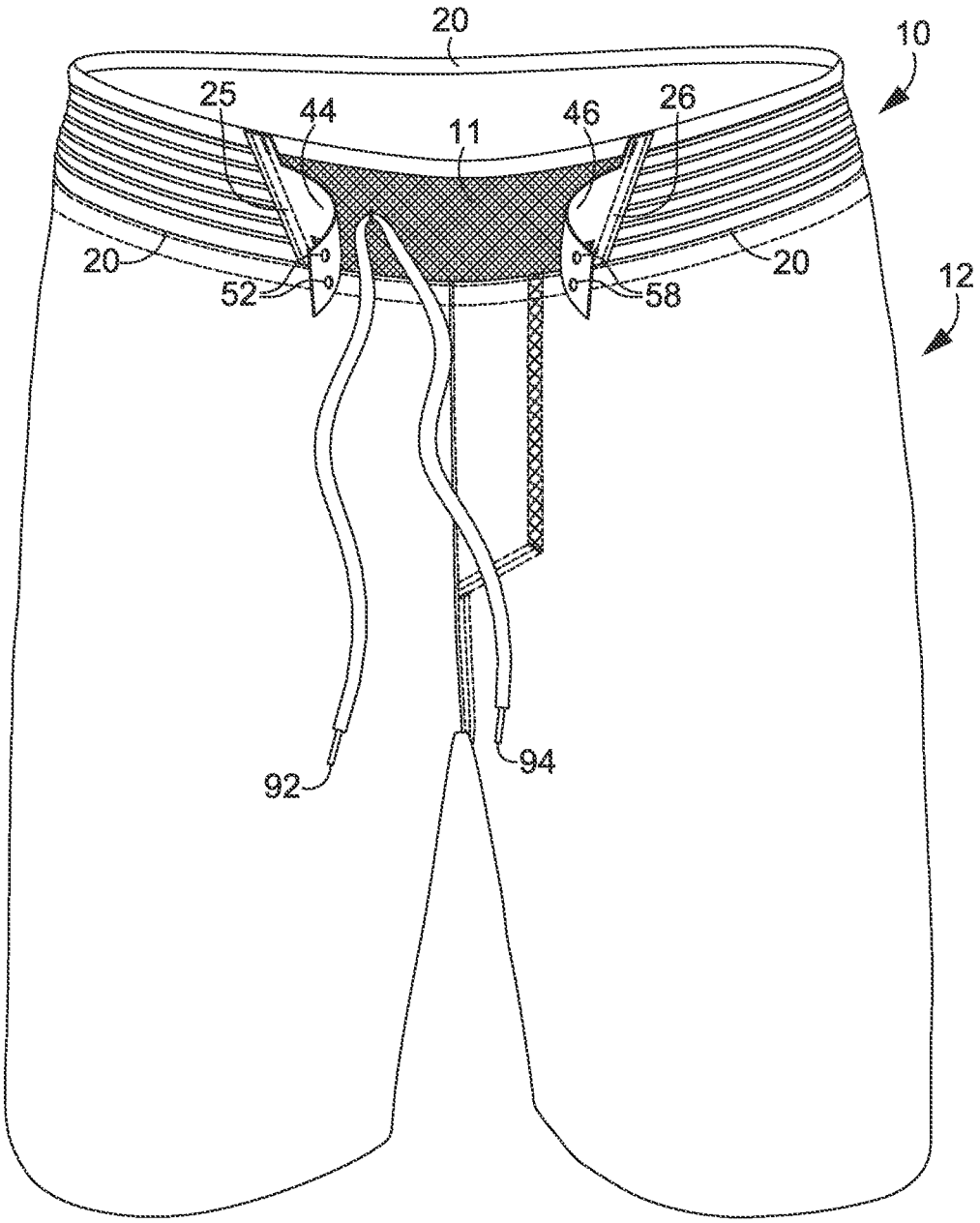
FIG. 6. depicts the article of apparel shown in FIG. 1 with an exemplary lacing cord, in accordance with an aspect hereof.

Referring to FIG. 6, the shorts 10 shown in FIG. 1, with the lacing cord 70 in an unthreaded configuration, is provided, in accordance with an aspect hereof. In FIG. 6, the lacing cord 70 is coupled to the joining portion 11 towards one side of the joining portion 11 (e.g., asymmetrically), which may allow for easier threading through the apertures 52, 58. Additionally, by asymmetrically affixing the lacing cord 70 to the joining portion 11, an improved aesthetics for the shorts 10 (e.g., providing a more uniform looking joining portion 11) may be achieved. The lacing cord 70 comprises a first end 92 and a second end 94. The first end 92 is configured to be initially threaded through the third pair of apertures 52 in the first tab portion 44, and the second end 94 is configured to be initially threaded through the fourth pair of apertures 58 in the second tab portion 46. As shown in FIG. 6, the joining portion 11 underlays the tab portions 44, 46 and extends between the first and second ends 25, 26 of the first waistband portion 20. This may allow improved modesty and securement of the waistband 12 at the waist area of the wearer.

Figure 7:
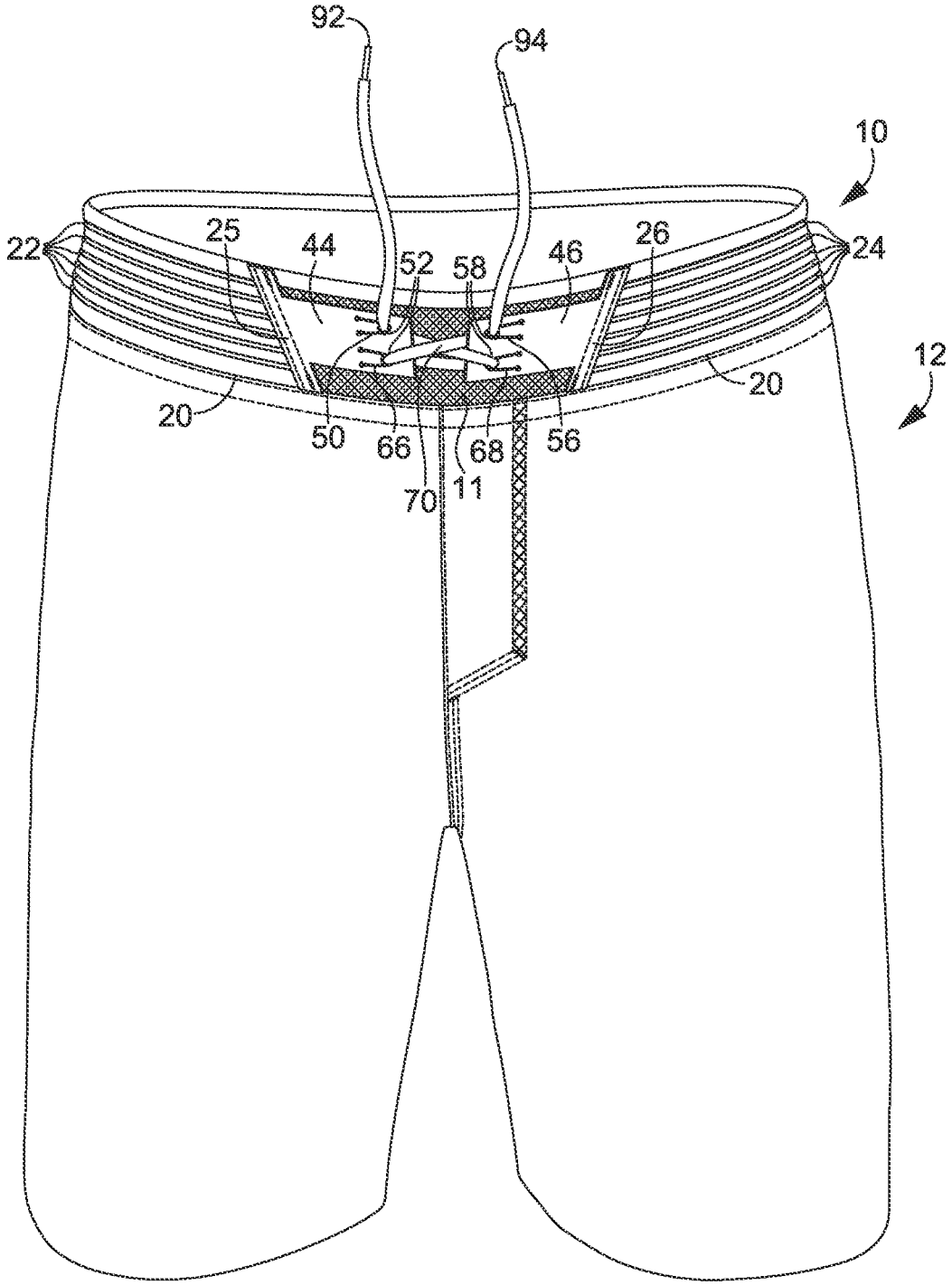
FIG. 7 depicts the article of apparel shown in FIG. 6 with the lacing cord threaded, in accordance with an aspect hereof.

Referring to FIG. 7, the article of apparel shown in FIG. 6 with the lacing cord 70 in a threaded configuration is provided, in accordance with an aspect hereof. In FIG. 7, the first and second ends 92, 94 of the lacing cord 70 have been threaded through the respective third pair of apertures 52 and fourth pair of apertures 58 on the respective first and second tab portions 44, 46. Additionally, the first and second ends 92, 94 of the lacing cord 70 have been threaded through the respective looped portions 50, 66 and 56, 68.

Continuing, in this respect, the first and second ends 92, 94, after threading and when pulled, can tension the respective first and second cords 28, 30 by pulling on the respective looped portions 50, 66 and 56, 68. The first and second cords 28, 30, being slidably coupled to the first waistband portion 20 by the respective first and second tunnel structures 22, 24, can be pulled further out of the respective first and second tunnel structures 22, 24 to expose a greater length or looped portion of the respective first and second cords 28, 30. Tensioning the first and second cords 28, 30 with the lacing cord 70 therefore may provide a circumferential tensioning force to the waistband 12, with enhanced leverage due to the looped portions 50, 66 and 56, 68 engaging with the respective first and second ends 92, 94 of the lacing cord 70. Furthermore, the configuration of the tunnel structures 22, 24 over the first waistband portion 20 may provide circumferential tensioning along a majority of the waistband 12, including at the front area 42, the rear area 80, the sides, the upper edge 13, lower edge 15, and the intervening area between the upper edge 13 and the lower edge 15. In exemplary aspects, any tension applied by the lacing cord 70 may be maintained by tying the lacing cord into, for instance, a bow configuration.

Figure 8A:
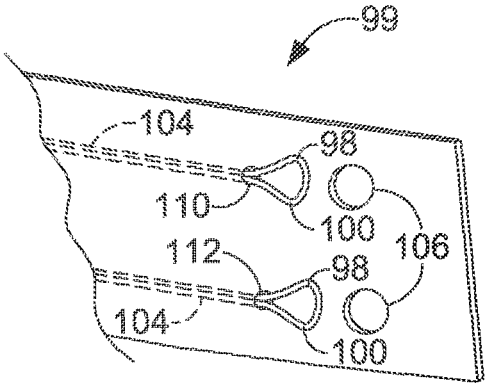
FIGS. 8A-8B depict exemplary configurations of a waistband that allow exposing of a cord in a tunnel structure of the waistband, in accordance with an aspect hereof.
Figure 8B:
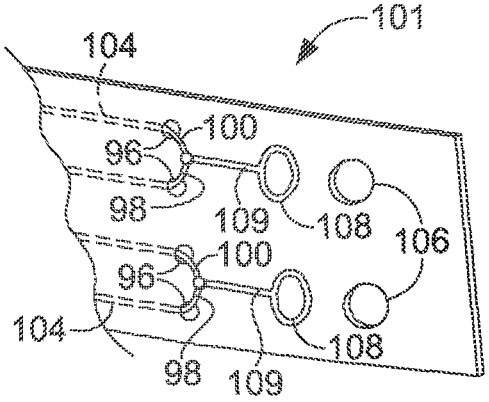

Referring to FIGS. 8A-8B, exemplary alternative configurations 99, 101 that allow exposure of a cord outside of a tunnel structure are provided, in accordance with an aspect hereof. Referring first to FIG. 8A, a first configuration 99 is provided that includes a first opening 110 and a second opening 112 providing access to a tunnel structure 104 in which a cord 100 is located. In FIG. 8A, a single opening in the tunnel structure 104 at each of the first opening 110 and the second opening 112 allows looped portions 98 of the cord 100 to be exposed, while the remainder of the cord 100 is covered by the tunnel structure 104. Referring to FIG. 8B, a second configuration 101 is provided. In FIG. 8B, the looped portions 98 of the cord 100 extend out of the apertures 96, and are coupled to respective connection pieces 109 having corresponding hooped apertures 108 through which a lacing cord (e.g., lacing cord 70) may be threaded. The connection pieces 109 may be formed from the same material as the cord, or may be formed from a rubber, silicone, polyurethane material, metal, plastic, or the like. The connection pieces 109 may be useful for reducing wear and tear on the cords 100.

Many different arrangements of the various components depicted, as well as use of components not shown, are possible without departing from the spirit and scope of the present disclosure. Aspects of the present disclosure have been described with the intent to be illustrative rather than restrictive. Alternative aspects will become apparent to those skilled in the art that do not depart from the scope. A skilled artisan may develop alternative means of implementing the aforementioned aspects without departing from the scope of the present disclosure. It will be understood that certain features and subcombinations are of utility and may be employed without reference to other features and subcombinations and are contemplated as within the scope of the claims.

What is claimed is:

1. A waistband, comprising:

a textile, comprising:

a first end, and a second end;

a tunnel structure forming a plurality of substantially parallel courses in the textile between the first end and the second end;

a cord extending at least partially through the tunnel structure, such that the cord is slidable through the tunnel structure; and a pair of apertures out of which a looped portion of the cord extends, wherein the textile has a higher degree of elasticity than the cord.

2. The waistband of claim 1, wherein the waistband forms part of an article of apparel.

3. The waistband of claim 2, wherein the article of apparel is a lower-body article of apparel.

4. The waistband of claim 3, wherein the lower-body article of apparel is a pair of shorts.

5. The waistband of claim 1, wherein the cord follows a continuous serpentine path through the plurality of substantially parallel courses and the pair of apertures.

6. The waistband of claim 1, wherein the plurality of substantially parallel courses extend across a surface of the textile.

7. The waistband of claim 1, wherein the textile comprises a woven textile.

8. The waistband of claim 1, wherein the textile comprises a knitted textile.

9. The waistband of claim 1, wherein the textile is a multi-layer fabric.

10. The waistband of claim 1, further comprising:
another tunnel structure extending through the textile;
another pair of apertures formed in the textile; and
another cord extending through the another tunnel structure and out of the another pair of apertures.

11. A waistband, comprising:
a textile, comprising:
a first end, and
a second end;
a tunnel structure forming a plurality of substantially parallel courses in the textile between the first end and the second end;
a cord extending at least partially through the tunnel structure, such that the cord is slidable through the tunnel structure; and
a pair of apertures out of which a looped portion of the cord extends,
wherein the cord follows a continuous serpentine path through the plurality of substantially parallel courses and the pair of apertures.

12. The waistband of claim 11, wherein the waistband forms part of an article of apparel.

13. The waistband of claim 12, wherein the article of apparel is a lower-body article of apparel.

14. The waistband of claim 13, wherein the lower-body article of apparel is a pair of shorts.

15. The waistband of claim 11, wherein the textile has a higher degree of elasticity than the cord.

16. The waistband of claim 11, wherein the plurality of substantially parallel courses extend across a surface of the textile.

17. The waistband of claim 11, wherein the textile comprises a woven textile.

18. The waistband of claim 11, wherein the textile comprises a knitted textile.

19. The waistband of claim 11, wherein the textile comprises a multi-layer fabric.

20. The waistband of claim 11, further comprising:
another tunnel structure extending through the textile;
another pair of apertures formed in the textile; and
another cord extending through the another tunnel structure and out of the another pair of apertures.

* * * * *